US008403144B2

(12) United States Patent
Eiten

(10) Patent No.: US 8,403,144 B2
(45) Date of Patent: Mar. 26, 2013

(54) LIQUID CONTAINER: SYSTEM FOR DISTRIBUTION

(75) Inventor: Carl T. Eiten, Bryon, IL (US)

(73) Assignee: Dean Intellectual Property Services II, Inc., Dallas, TX (US)

( * ) Notice: Subject to any disclaimer, the term of this patent is extended or adjusted under 35 U.S.C. 154(b) by 666 days.

(21) Appl. No.: 12/562,661

(22) Filed: Sep. 18, 2009

(65) Prior Publication Data

US 2010/0213095 A1 Aug. 26, 2010

Related U.S. Application Data

(63) Continuation-in-part of application No. 11/780,197, filed on Jul. 19, 2007, now Pat. No. 8,047,392.

(60) Provisional application No. 61/162,510, filed on Mar. 23, 2009, provisional application No. 60/893,061, filed on Mar. 5, 2007.

(51) Int. Cl.
*B65D 21/00* (2006.01)

(52) U.S. Cl. ..... 206/509; 206/499; 206/564; 220/23.83; 264/522; 414/781; 414/816

(58) Field of Classification Search ..... 220/23.83; 206/499, 509, 564; 264/522; 414/781, 816
See application file for complete search history.

(56) References Cited

U.S. PATENT DOCUMENTS

| | | | |
|---|---|---|---|
| 255,900 | A | 4/1882 | Thorpe |
| 353,600 | A | 11/1886 | Sloan |
| 1,190,203 | A | 7/1916 | Sorge, Jr. |
| 2,077,027 | A | 4/1937 | Torras |
| 2,641,374 | A | 10/1949 | Der Yuen |
| 2,631,747 | A | 3/1953 | Stolte |
| D189,372 | S | 11/1960 | Adell |
| 2,960,248 | A | 11/1960 | Kuhlman |
| D199,203 | S | 9/1964 | Dailey |
| 3,194,426 | A | 7/1965 | Brown, Jr. |
| D203,226 | S | 12/1965 | Schnur et al. |
| 3,323,668 | A | 6/1967 | Hills |
| 3,369,658 | A | 2/1968 | Hasselmann |
| 3,369,688 | A | 2/1968 | Dike |
| 3,391,824 | A | 7/1968 | Wiseman |
| 3,397,724 | A | 8/1968 | Bolen et al. |
| 3,485,355 | A | 12/1969 | Stewart |
| 3,708,082 | A | 1/1973 | Platte |

(Continued)

FOREIGN PATENT DOCUMENTS

| | | |
|---|---|---|
| AU | 606090 | 11/1987 |
| CA | 2070899 | 6/1992 |

(Continued)

OTHER PUBLICATIONS

U.S. Appl. No. 12/562,700, inventor Eiten et al., "Stackable Liquid Container with Tunnel-Shaped Base," 29 pages plus 7 pages of drawings, filed Sep. 18, 2009.

(Continued)

*Primary Examiner* — Anthony Stashick
*Assistant Examiner* — Elizabeth Volz
(74) *Attorney, Agent, or Firm* — Baker Botts L.L.P.

(57) ABSTRACT

According to one embodiment, a distribution assembly is used to distribute a load of liquid containers. The distribution assembly may include a slip sheet, a pallet divider, and a rotating pallet. The slip sheet may be designed to laterally group two or more liquid containers. The pallet divider may divide the load into sections, each section containing a stack of liquid containers. The pallet divider may restrict access to one of the sections to distribute the liquid containers of the other section. The rotating pallet may rotate the load to allow the other section to be accessed.

22 Claims, 7 Drawing Sheets

U.S. PATENT DOCUMENTS

| | | | | |
|---|---|---|---|---|
| 3,765,574 | A | 10/1973 | Urquiza | |
| 3,819,847 | A | 6/1974 | Charles | |
| 3,889,834 | A | 6/1975 | Harris, Jr. | |
| 3,972,450 | A | 8/1976 | Walters | |
| 4,133,445 | A | 1/1979 | Mandelbaum | |
| 4,165,812 | A | 8/1979 | Jennison | |
| 4,170,082 | A | 10/1979 | Freedman | |
| 4,308,955 | A | 1/1982 | Schieser et al. | |
| 4,351,454 | A | 9/1982 | Maynard, Jr. | |
| D266,690 | S | 10/1982 | Levin | |
| 4,416,373 | A | 11/1983 | deLarosiere | |
| 4,433,954 | A | 2/1984 | Fujita | 414/757 |
| 4,458,467 | A * | 7/1984 | Shulman et al. | 53/399 |
| 4,485,923 | A | 12/1984 | Schwaikert | |
| D282,244 | S | 1/1986 | Santoiemmo | |
| D282,347 | S | 1/1986 | Steiner | |
| 4,565,043 | A | 1/1986 | Mazzarese | |
| 4,570,799 | A | 2/1986 | Mednis | |
| 4,589,560 | A | 5/1986 | Harris, Jr. | |
| 4,609,106 | A | 9/1986 | Gentili | |
| 4,624,383 | A | 11/1986 | Moore | |
| 4,685,565 | A | 8/1987 | Sparling | |
| 4,691,828 | A | 9/1987 | Slusarczyk et al. | |
| 4,708,253 | A | 11/1987 | Mednis | |
| 4,793,516 | A | 12/1988 | Niwa et al. | |
| 4,805,793 | A | 2/1989 | Brandt et al. | |
| 4,838,450 | A | 6/1989 | Bocchi | |
| D307,389 | S | 4/1990 | Larson | |
| 5,002,199 | A | 3/1991 | Frahm | |
| 5,064,101 | A | 11/1991 | Richter et al. | |
| 5,105,858 | A | 4/1992 | Levinson | |
| 5,119,972 | A | 6/1992 | Reed et al. | |
| 5,125,538 | A | 6/1992 | Morris, Sr. | |
| 5,133,469 | A | 7/1992 | Mehta et al. | |
| 5,217,128 | A | 6/1993 | Stenger | |
| 5,244,106 | A | 9/1993 | Takacs | |
| 5,299,710 | A | 4/1994 | Welsch et al. | |
| 5,312,011 | A | 5/1994 | Fischer | |
| 5,316,159 | A | 5/1994 | Douglas et al. | |
| 5,330,050 | A * | 7/1994 | Stansbury et al. | 206/386 |
| 5,409,128 | A | 4/1995 | Mitchell | |
| 5,447,249 | A | 9/1995 | Vickers | |
| 5,516,562 | A | 5/1996 | Edwards et al. | |
| 5,535,910 | A | 7/1996 | Cassel | |
| 5,573,133 | A | 11/1996 | Park | |
| 5,697,500 | A | 12/1997 | Walker | |
| 5,699,925 | A | 12/1997 | Petruzzi | |
| 5,779,051 | A | 7/1998 | Boutin | |
| 5,782,358 | A | 7/1998 | Walker | |
| 5,833,115 | A | 11/1998 | Eiten | |
| 5,866,419 | A | 2/1999 | Meder | |
| D407,020 | S | 3/1999 | Doty | |
| 5,887,740 | A | 3/1999 | Hong | |
| 5,927,499 | A | 7/1999 | Vesborg | |
| D417,621 | S | 12/1999 | Hofmeister et al. | |
| 6,050,455 | A | 4/2000 | Soehnlen et al. | |
| 6,053,345 | A | 4/2000 | Jones | |
| 6,068,161 | A | 5/2000 | Soehnlen et al. | |
| 6,082,541 | A | 7/2000 | Bewick | |
| 6,095,332 | A | 8/2000 | Finand et al. | |
| 6,123,196 | A | 9/2000 | Chiu | |
| 6,202,881 | B1 | 3/2001 | Chiang | |
| 6,223,942 | B1 | 5/2001 | Markey et al. | |
| 6,230,892 | B1 | 5/2001 | Przytulla et al. | |
| 6,237,792 | B1 | 5/2001 | Skolnicki et al. | |
| 6,269,949 | B1 | 8/2001 | Gottlieb | |
| 6,276,549 | B1 | 8/2001 | Fasci et al. | |
| 6,325,212 | B2 | 12/2001 | Przytulla et al. | |
| 6,367,631 | B1 | 4/2002 | Steigerwald | |
| 6,419,783 | B1 | 7/2002 | Rainey et al. | |
| 6,446,680 | B1 | 9/2002 | Soehnlen et al. | 141/9 |
| 6,497,333 | B1 | 12/2002 | Ellis et al. | |
| 6,527,133 | B1 | 3/2003 | McCollum et al. | |
| 6,588,612 | B1 | 7/2003 | Dorn et al. | |
| 6,591,986 | B2 | 7/2003 | Soehnlen et al. | |
| D487,697 | S | 3/2004 | Rosen | |
| D489,271 | S | 5/2004 | Soomar | |
| 6,772,898 | B1 | 8/2004 | Florino et al. | |
| 7,097,059 | B2 | 8/2006 | Saito | |
| D532,694 | S | 11/2006 | Darr et al. | |
| 7,467,714 | B2 * | 12/2008 | Slat et al. | 206/509 |
| 7,543,713 | B2 | 6/2009 | Trude et al. | |
| 7,726,106 | B2 | 6/2010 | Kelly et al. | |
| 7,735,304 | B2 | 6/2010 | Kelley et al. | |
| 8,047,392 | B2 | 11/2011 | Eiten | |
| 2001/0045370 | A1 | 11/2001 | Soehnlen et al. | |
| 2002/0077225 | A1 | 6/2002 | Selsam | |
| 2003/0010743 | A1 | 1/2003 | Boukobza | |
| 2003/0121926 | A1 | 7/2003 | Soehnlen et al. | |
| 2003/0132184 | A1 | 7/2003 | Dorn et al. | |
| 2003/0196926 | A1 | 10/2003 | Tobias et al. | |
| 2003/0221987 | A1 | 12/2003 | Trude | |
| 2003/0234200 | A1 | 12/2003 | Diamant | |
| 2004/0178161 | A1 | 9/2004 | Galustyan | |
| 2006/0096942 | A1 | 5/2006 | Lane | |
| 2006/0255000 | A1 | 11/2006 | Quintana | |
| 2006/0260971 | A1 * | 11/2006 | Rivera et al. | 206/509 |
| 2007/0114200 | A1 | 5/2007 | Lane | |
| 2008/0217200 | A1 | 9/2008 | Eiten et al. | |

FOREIGN PATENT DOCUMENTS

| | | |
|---|---|---|
| CA | 2141361 | 1/1995 |
| CA | 2320789 | 3/1999 |
| CH | 629148 | 4/1982 |
| DE | 4014520 | 11/1991 |
| EP | 705765 | 9/1995 |
| EP | 771735 | 5/1997 |
| EP | 8428859 | 5/1998 |
| EP | 1321370 | 12/2001 |
| GB | 887893 | 7/1959 |
| GB | 2344095 | 5/2000 |
| GB | 2404915 | 2/2005 |
| JP | 11011451 | 6/1997 |
| JP | 2001 180635 A | 12/1999 |
| JP | 2000072125 | 3/2000 |
| JP | 2002114225 | 4/2002 |
| JP | 2003072757 | 3/2003 |
| JP | 2004182334 | 7/2004 |
| WO | WO 8805014 | 7/1988 |
| WO | WO 9206897 | 4/1992 |
| WO | WO 9402368 | 2/1994 |
| WO | WO 0162612 | 2/2001 |
| WO | WO 2004011340 | 6/2003 |

OTHER PUBLICATIONS

Combined Search and examination Report Under Section 17 and 18(3) in European Patent No. GB 0803837.4, 8 pages, Jun. 2, 2008.

USPTO Office Action, U.S. Appl. No. 11/780,197, 8 pages, Oct. 10, 2008.

USPTO Office Action, U.S. Appl. No. 11/780,197, 8 pages, Nov. 24, 2008.

USPTO Office Action, U.S. Appl. No. 11/780,197, 7 pages, Jun. 3, 2009.

USPTO Final Office Action, U.S. Appl. No. 11/780,197, 8 pages, Oct. 19, 2009.

USPTO Office Action, U.S. Appl. No. 11/780,197, 7 pages, Jan. 13, 2010.

USPTO Final Office Action, U.S. Appl. No. 11/780,197, 8 pages, May 14, 2010.

"Stacking pc water bottle gives more capacity with less weight", Mod. Plast. Int. 11, No. 7, Jul. 1981, p. 19.

Stark, L. "Development of plastics containers for packaging milk products" Anyagmozgatas Csomagolas, 1984.

Grieb, et al., "Single-service plastics package, particularly plastics bottle." German Federal Republic Patent Application 1972.

USPTO Office Action, U.S. Appl. No. 11/780,197, 10 pages, dated Aug. 30, 2010.

U.S. Appl. No. 60/629,780 to Rivera, et al. filed Nov. 20, 2004, 24 pages.

Carl T. Eiten, U.S. Appl. No. 12/562,700, Office Action from the U.S. PTO dated Oct. 4, 2011.

Carl T. Eiten, U.S. Appl. No. 12/562,700, Response to Office Action from the U.S. PTO mailed Dec. 30, 2011.
Carl T. Eiten, U.S. Appl. No. 12/562,700, Final Office Action from the U.S. PTO dated Mar. 2, 2012.
Carl T. Eiten, U.S. Appl. No. 12/562,700, Response to Final Office Action from the U.S. PTO mailed Mar. 28, 2012.
USPTO Office Action U.S. Appl. No. 11/780,197; to Carl T. Eiten; 7 pages dated Apr. 26, 2011.
Carl T. Eiten et al. "Amendment Pursuant to 37 C.F.R. §1.111" filed Jul. 20, 2011, 10 pages.

* cited by examiner

LIQUID CONTAINER: SYSTEM FOR DISTRIBUTION

RELATED APPLICATIONS

This application is a Continuation-in-Part and claims the benefit of priority under 35 U.S.C. §120 of U.S. patent application Ser. No. 11/780,197, filed Jul. 19, 2007 now U.S. Pat. No. 8,047,392, and entitled "STACKABLE LIQUID CONTAINER," which claims the benefit of priority under 35 U.S.C. §119(e) of U.S. Provisional Application Ser. No. 60/893,061, filed Mar. 5, 2007, and entitled "STACKABLE LIQUID CONTAINER." This application claims the benefit of priority under 35 U.S.C. §119(e) of U.S. Provisional Application Ser. No. 61/162,510, filed Mar. 23, 2009, and entitled "LIQUID CONTAINER: SYSTEM AND METHOD FOR USE AND DISTRIBUTION THEREOF."

TECHNICAL FIELD

This disclosure relates in general to liquid containers and, more particularly, to a system and method for use and distribution thereof.

BACKGROUND

Liquid products are typically distributed from a manufacturer to consumers in liquid containers that may be easily handled and transported by the consumer. These liquid containers are generally formed of a liquid impermeable material that may be, for example, a thermoplastic, such as polyethylene or other similar material. The capacity of these liquid containers may be several gallons or less such that handling and transport of the containers do not create an undue burden to the consumer.

Known liquid product distribution practices have utilized ancillary support structures, such as the commonly known "milk crate." The milk crate is a generally rigid structure into which a number of liquid containers may be placed and has an upper rim that provides for support of another milk crate disposed above. The milk crate enables stacking of multiple liquid containers within the milk crate, one upon another, by eliminating downward directed forces from the liquid containers stored inside.

SUMMARY

According to one embodiment, a distribution assembly is used to distribute a load of liquid containers. The distribution assembly may include a slip sheet, a pallet divider, and a rotating pallet. The slip sheet may be designed to laterally group two or more liquid containers. The pallet divider may divide the load into sections, each section containing a stack of liquid containers. The pallet divider may restrict access to one of the sections to distribute the liquid containers of the other section. The rotating pallet may rotate the load to allow the other section to be accessed.

Embodiments of the disclosure may provide numerous technical advantages. According to some embodiments, a distribution assembly may be used to efficiently store and distribute a load comprising liquid containers. In some embodiments, the distribution assembly may distribute liquid containers having a stackable shape. The liquid containers may be stacked in layers, each layer being held together by a slip sheet. The stackable shape together with the slip sheets may provide structural integrity to the load so that the liquid containers may be distributed without the use of a milk crate.

In some embodiments, the distribution assembly may comprise a rotating pallet. The rotating pallet may rotate the load to move an unreachable liquid container closer to a customer.

Some, none, or all embodiments may benefit from the below described advantages. Other technical advantages will be apparent to one of skill in the art.

BRIEF DESCRIPTION OF THE DRAWINGS

A more complete understanding of embodiments of the disclosure will be apparent from the detailed description taken in conjunction with the accompanying drawings in which.

DETAILED DESCRIPTION

Known liquid containers for consumer products such as milk, may not be designed to support the weight of other liquid containers. Thus, milk crates may be used to store the relatively delicate known liquid containers. The milk crates protect the liquid container from damage by eliminating downward directed forces from other items stored on top. Usage of these milk crates, however, is a generally inefficient practice. That is, these milk crates serve little purpose to the consumer and therefore are transported back to the manufacturer following distribution to the consumer. The teachings of the present disclosure provide a liquid container that alleviates the costs and burden associated with shipping and storage of a plurality of liquid containers in known ancillary support structures, such as milk crates.

Figure 1:
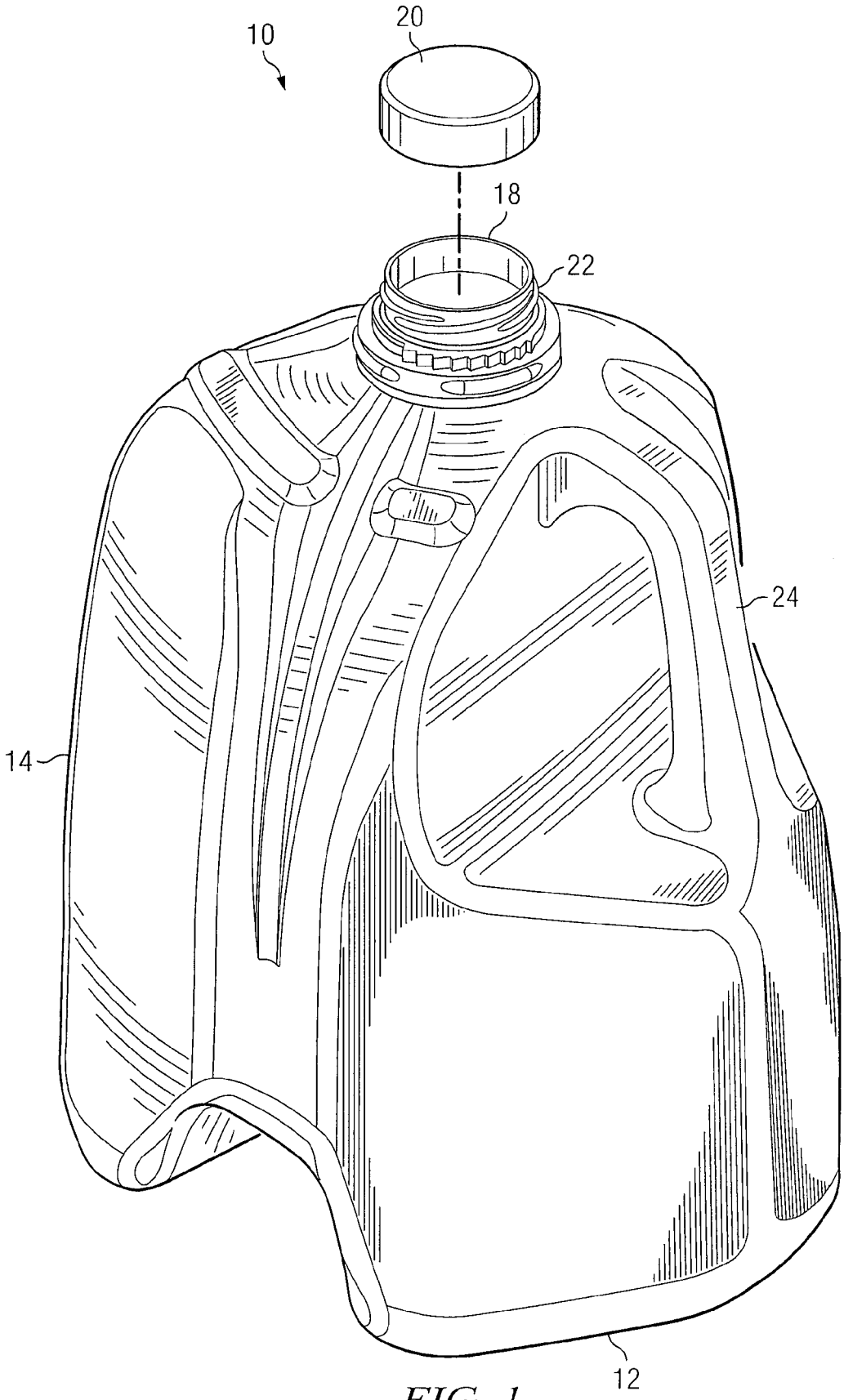
FIG. 1 is an embodiment of a liquid container.

FIG. 1 shows one embodiment of a liquid container 10 in accordance with a particular embodiment of this disclosure. Liquid container 10 has a number of features that may enable stacking of multiple liquid containers 10, one upon another. In one embodiment, the liquid containers 10 may be stacked without the need for ancillary support structures, such as milk crates.

Liquid container 10 generally includes a base member 12, a sidewall member 14, a neck member 16, a spout 18, and a handle 24. The sidewall member 14 is integrally formed and extends upwardly from the base member 12. The upper end of the sidewall member 14 is interconnected to the spout 18 by the generally frusto-conical shaped, upwardly converging neck member 16. Together, the base member 12, sidewall member 14, neck member 16, and spout 18 form a chamber for the storage and containment of a liquid therein. In a normal upright orientation, the base member 12 lies in a generally horizontal orientation such that the spout 18 exists at the apex of the liquid container 10. The spout 18 comprises a generally hollow opening for pouring liquids to and from the container 10.

The spout 18 may also have an associated closure cap 20 for removable placement over the spout 18. In the particular embodiment shown, thread-like ridges 22 may be included on the outer periphery of the spout 18 for securing the closure cap 20 to the spout 18. However, the cap 20 may comprise any type of industry standard dairy cap having screw-on, snap-on, or similar type selective attachment means. Caps of this nature may be available from Portola, located in Batavia, Ill.

Figure 2:
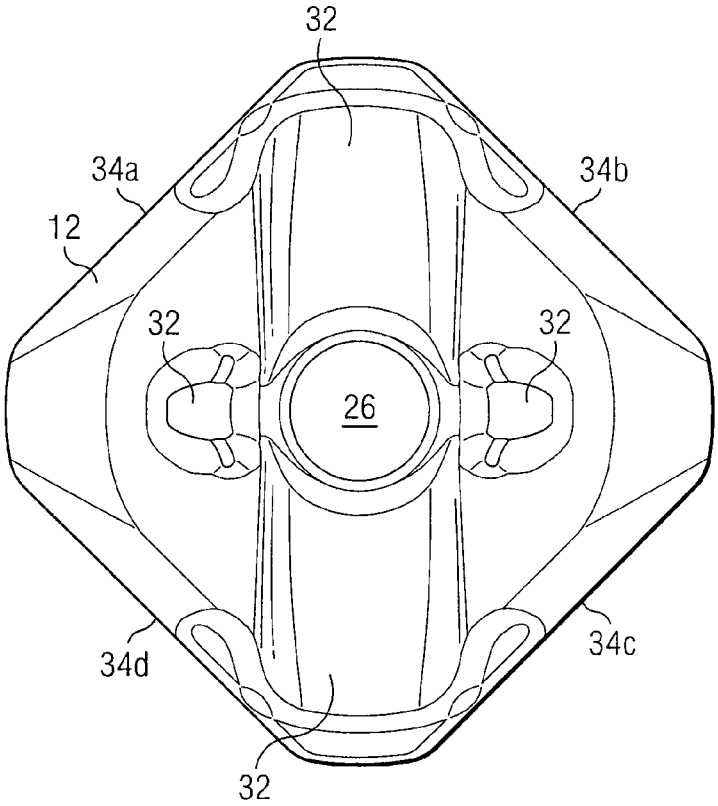
FIG. 2 is a bottom view of the liquid container of FIG. 1.

FIG. 2 is a bottom view showing various features of the base member 12. The base member may be substantially square in shape, with sides 34. Side 34*a* may be adjacent to sides 34*b* and 34*d*, and opposite to side 34*c*. The base member 12 may be generally flat in shape for relatively stable placement of the liquid container 10 on a flat surface, such as a tabletop, with the exception of a recessed portion 26 and slots 32. The recessed portion 26 and slots 32 project upwardly from the base member 12 for reasons to be described below. One or more of the slots 32 formed by the base may be shaped like a tunnel. In some embodiments, the tunnel may project upwardly from the base member 12 to create a cavity that may extend diagonally from one corner of the base member 12 to an opposite corner of the base member 12. For example, the tunnel may extend from the corner formed by the intersection of side 34*a* and side 34*b* to the corner formed by the intersection of side 34*c* and side 34*d*.

Figure 3:
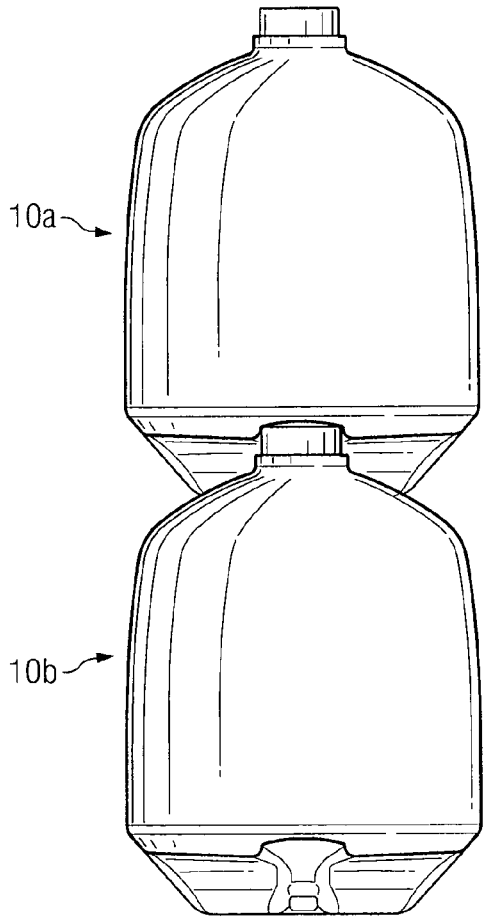
FIG. 3 illustrates the stacking of two liquid containers.

FIG. 3 illustrates the arrangement of one liquid container 10*a* stacked on top of another liquid container 10*b*. Support for another liquid container 10*a* on top of liquid container 10*b* may be provided by recessed portion 26. The recessed portion 26 projects upwardly into the container 10, such that the base member 12 of liquid container 10*a* may rest upon the neck member 16 of liquid container 10*b*. Because the recessed portion 26 allows the base member 12 of one container 10*a* to rest upon the neck member 16 of another container 10*b*, the weight of container 10*a* and its liquid contents may be generally evenly distributed around the upper surface of the neck member 16 of container 10*b* in close proximity to the sidewall member 14.

The spout 18 is significantly smaller in diameter than the sidewall member 14 such that the neck member 16 converges from the sidewall member 14 to the spout 18 in a generally frusto-conical shape. This upwardly converging shape however, does not easily lend itself to transferring downward directed forces caused by the weight of liquid container 10*a* placed directly upon the spout 18 of container 10*b*. The teachings of the present disclosure may provide a solution to this need via a liquid container 10 having a base member 12 that is configured to rest directly upon the neck member 16 of another container 10*b* such that downward directed forces caused by the weight of the container 10*a* and its contents, are efficiently transferred to the sidewall member 14 of the container 10*b* disposed underneath.

Stacking the liquid containers 10 by nesting the spout of a first container in the recessed portion of a second container may encourage consumers to remove individual liquid containers 10 from a stack using a lifting motion rather than a lateral motion. A lifting motion may be preferred over a lateral motion because a lateral motion may tend to dislodge or tip liquid container(s) 10 located below the individual liquid container 10 being removed.

Figure 4:
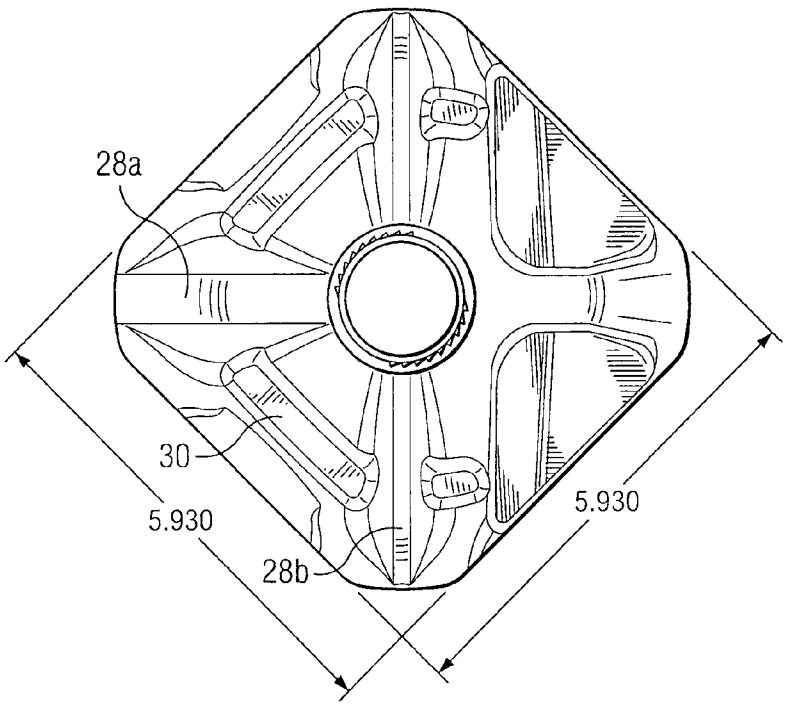
FIG. 4 is a top view of the liquid container of FIG. 1.

FIG. 4 is a top view of the liquid container of FIG. 1. In one embodiment, the neck member 16 may have at least one rib 28 that extends approximately from the spout to approximately the sidewall member 14. Any quantity of ribs 28 may be utilized within the teachings of the present disclosure. The ribs 28 may provide enhanced structural rigidity by transferring localized forces incident upon the neck member onto the sidewall member 14. The ribs 28 may also transfer forces incident upon the spout 18 toward the sidewall member 14. The ribs 28 may operate in conjunction with handle 24 in order to form a relatively robust structure for distributing weight placed upon the liquid container 10 in a generally even manner. In order to evenly distribute the weight around the entire periphery of the sidewall member 14, the ribs 28 and handle 24 may be evenly spaced around the neck member 16 of the liquid container 10.

In another embodiment, the neck member 16 may also have one or more support projections 30. The support projections 30 may protrude upwardly from the neck member 16 and extend over at least a portion of the neck member 16. In one embodiment, a support projection 30 may extend from a first rib 28 to an adjacent rib 28, such as from rib 28*a* to rib 28*b*. The support projections 30 may provide a relatively stable support surface for the base member 12 of another liquid container 10 placed on top. In certain embodiments, the support projections 30 may enhance the stability of one container 10 when placed on top of another container 10 by supporting the container 10 at the base member 12, which is generally flat in shape.

In one embodiment, the recessed portion 26 has a contour that generally conforms to the contour formed by the neck member 16, closure cap 20, ribs 28, handle 24, support projection 30, and/or any other structural member that extends generally upwardly from the neck member 16 or spout 18 of the liquid container 10. The ribs 28 may be configured on neck member 16 such that they at least partially fit into cavities formed by slots 32 in base member 12. When fitted into slots 32, the ribs 28 may prevent rotation of one particular liquid container 10 that is stacked upon another liquid container 10.

Figure 5:
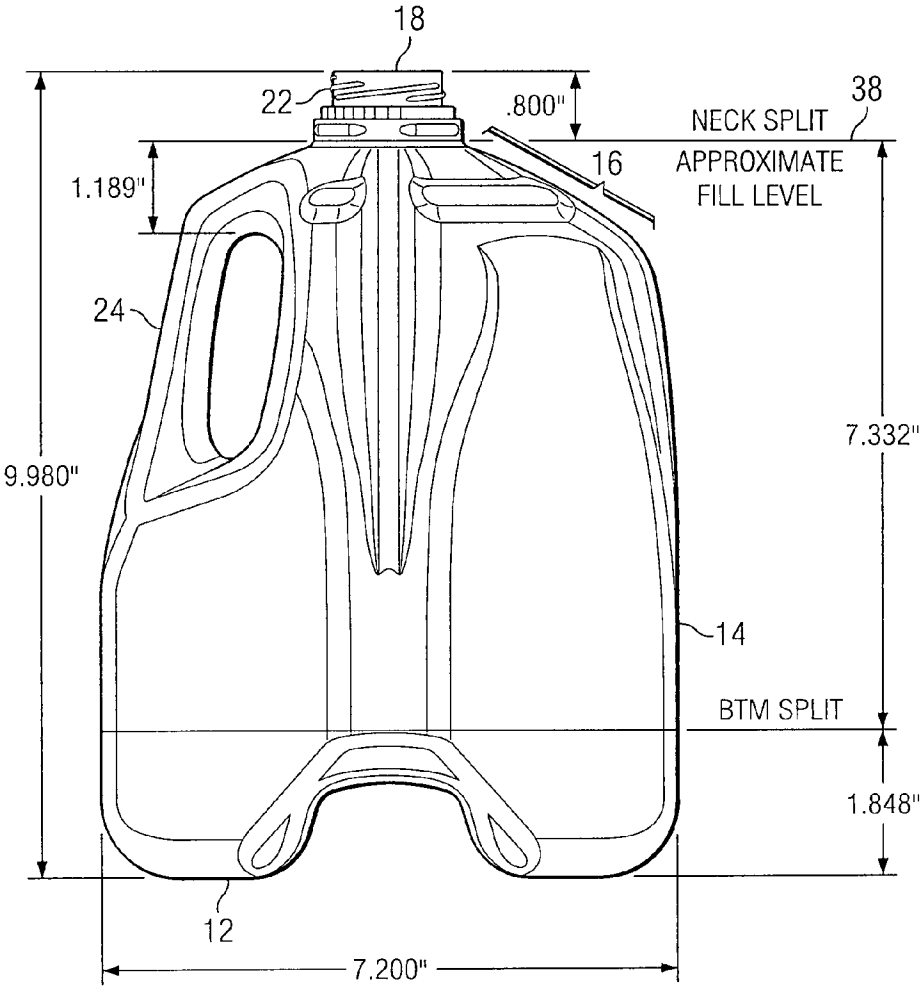
FIG. 5 illustrates the dimensions of an embodiment of the liquid container of FIG. 1.

FIG. 5 illustrates the dimensions of an embodiment of the liquid container 10 of FIGURE. For dimensioning purposes, the container may have a neck split 38 and a bottom split 39. The overall height of the liquid container 10 may be approximately 9.98 inches, and the height may be distributed approximately as follows: 1.85 inches from the bottom of the base member 12 to the bottom split 39, 7.33 inches from the bottom split 39 to the neck split 38, and 0.80 inches from the neck split to the top of the spout 18. Additionally, a cavity formed by handle 24 may be located approximately 1.19 inches from neck split 39. The base member 12 of the liquid container 10 may be substantially square in shape, with an area of approximately 5.93 square inches. The spout 18 of the liquid container 10 may be approximately 1.89 inches in diameter The particular liquid container 10 as disclosed is configured to have a fill capacity of 128.0 fluid ounces and an overflow capacity of 128.7 fluid ounces. It will be understood however, that a container having other capacities could be constructed using the teachings of this disclosure. Moreover, containers formed according to the teachings of the present disclosure having different sizes, configurations, and/or fill capacities may have dimensions other than those previously described.

The container 10 may be particularly suited for transport and distribution of various types of liquid products from a manufacturer to consumers. The type of liquid products may include consumable foodstuffs such as juice, water, milk, and the like, or other types of liquids such as chemical formulations for home, automotive, commercial, or industrial use. The liquid container 10 may be constructed of a high density polyethylene (HDPE) plastic material, which is generally "food safe", for storage of human consumable liquids. However, the liquid container 10 may formed from any suitable plastic material appropriate for the type of liquid it is adapted to contain. Nevertheless, the present embodiment may be formed using conventional blow molding techniques, which are well known to those skilled in the art.

In some embodiments, conventional blow molding techniques may be performed by a two-part machine or a three-part machine. A two-part machine may manufacture the liquid container 10 in two parts, such as a front part and a back part. A three-part machine may manufacture the liquid container 10 in three parts, such as a front part, a back part, and a base part. Manufacturing the liquid container 10 using a two-part machine may provide certain advantages. For example, manufacturing the liquid container 10 from two parts may increase its columnar strength. As another example, a two-part machine may be simpler, more efficient, and/or more cost effective than other machines. Additionally, a two-part machine may be more commonly used in the industry and, thus, more readily available. In some embodiments, the liquid container 10 may be shaped to be manufactured by two-part machine. For example, one or more slots 32 of FIG. 2 may have a tunnel shape. In some embodiments, the tunnel may be substantially centered at the seam where the front part and the back part are joined.

Figure 6:
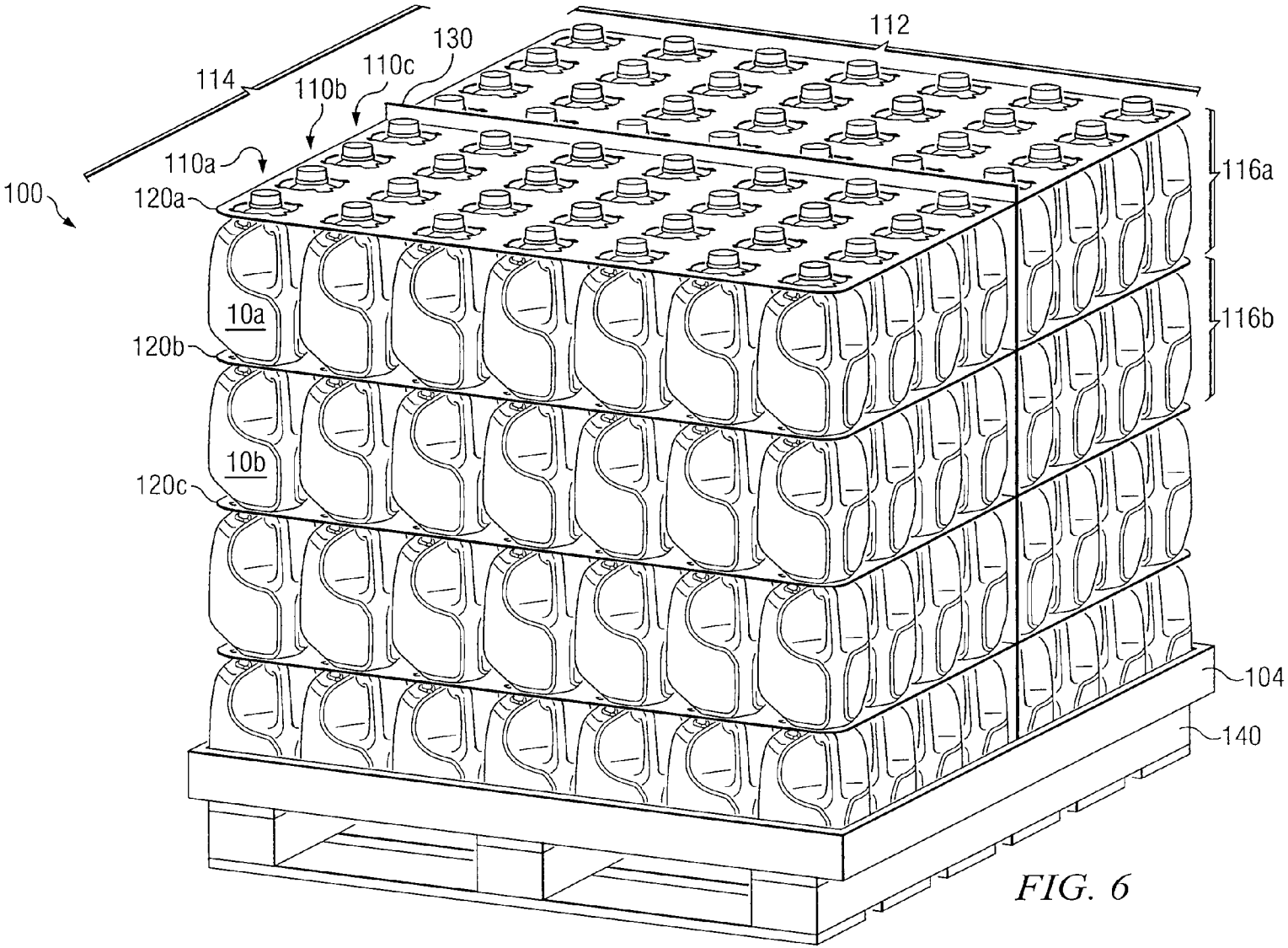
FIG. 6 illustrates an embodiment of a distribution assembly that may be used to distribute liquid containers.

According to some embodiments, a distribution assembly may be used to distribute liquid containers. FIG. 6 illustrates an embodiment of a distribution assembly 100 that may be used to distribute liquid containers 10. The distribution assembly 100 may comprise a pallet holder 104, a slip sheet 120, a pallet divider 130, and/or a rotating pallet 140.

In some embodiments, the pallet holder 104 may be used to provide a support surface for shipping and storing a load comprising a number of liquid containers 10. The pallet holder 104 may be any pallet holder suitable for providing a substantially flat, rigid surface on which the bottom layer of liquid containers 10 may rest. In some embodiments, the pallet holder 104 may be a five-sided case, box, or tray. In one embodiment, pallet holder 104 is a Chep pallet. In some embodiments, the pallet holder 104 may be made of a disposable material such as cardboard. The pallet holder 104 may define the outer perimeter of the load. The pallet holder 104 may be any suitable size to support the liquid containers. In some embodiments, the pallet holder 104 may be approximately 48 inches long and 40 inches wide. In some embodiments, the depth of the pallet holder 104 may be less than six inches.

According to some embodiments, the load may comprise any suitable number of liquid containers 10, such as 224 liquid containers 10. The liquid containers 10 may be logically organized into container stacks 110, container rows 112, and container columns 114. The container stacks 110 may be arranged vertically, the container rows 112 may be arranged horizontally along the length of the pallet holder 104, and the container columns 114 may be arranged horizontally along the width of the pallet holder 104.

According to some embodiments, each container stack 110 may be formed by stacking liquid containers 10. The liquid containers 10 may be stacked such that the spout of a first liquid container 10*b* nests in the recessed portion of a second liquid container 10*a*. Any suitable number of liquid containers 10 may be stacked in a container stack 110. In some embodiments, the container stack 110 may comprise four liquid containers 10. In some embodiments, the position of a liquid container 10 in its container stack 110 may be counted with respect to the ground. That is, the liquid container 10 closest to the ground may be first in the stack, the liquid container 10 seated directly on the first liquid container may be second in the stack, and so on.

In some embodiments, the container stacks may be arranged in a rectangular array to form the container rows 112 and the container columns 114. Any suitable number of container stacks 110 may be used in the arrangement. In some embodiments, fifty-six container stacks 110 may be arranged in an 8×7 arrangement.

The container rows 112 and the container columns 114 with the same vertical stack positions may define a horizontal plane. The horizontal plane may be referred to as a layer 116 of liquid containers 10. As an example, a load configured in an 8×7 arrangement stacked four deep may have four layers 116. Each layer 116 may comprise eight container rows 112 and seven container columns 114. According to the illustrated example, liquid container 10*a* and liquid container 10*c* may both be fourth in their respective container stacks 110 and may therefore both belong to the layer 116*a*.

According to some embodiments, a slip sheet 120 may be used to hold together a number of liquid containers 10 belonging to the same layer 116. In some embodiments, the slip sheet 120 may hold together all of the liquid containers 10 belonging to the same layer 116. Alternatively, the slip sheet 120 may hold together a subset of liquid containers 10 belonging to the same layer 116, such as one-half of the liquid containers 10. Holding the layers 116 of liquid containers 10 together may increase the lateral stability of the load.

In some embodiments, the slip sheet 120 may be placed between the layers 116 of liquid containers 10. For example, the slip sheet 120*b* may be placed between the layer 116*b* comprising liquid container 10*b* and the layer 116*a* comprising liquid container 10*a*. The slip sheet 120*b* may fit over the spout and part of the neck member of the liquid container 10*b*. The liquid container 10*a* may be partially seated on the slip sheet 120*b*. In some embodiments, the slip sheet 120*b* may distribute and/or support some of the weight of the liquid container 10*a*. The weight distribution and/or support may provide increased structural integrity to the container stack 110*a*.

According to some embodiments, a pallet divider 130 may divide the load of the distribution assembly 100 into multiple sections. In some embodiments, the pallet divider 130 may increase the stability of the load by supporting a portion of the weight and/or aiding the alignment of the liquid containers 10. The pallet divider 130 may be any suitable material, such as corrugated cardboard.

In some embodiments, the pallet divider 130 may restrict a customer's access to a section of the load to organize the order in which the liquid containers 10 are distributed. In some embodiments, the pallet divider 130 may divide the load into a half-pallet configuration comprising two sections. A half-pallet configuration for an 8×7 arrangement of container stacks 110 may comprise two 4×7 sections of container stacks 110. A half-pallet configuration may reduce the maximum distance the customer may reach to remove a liquid container. For example, the customer may only have to reach halfway into the load to reach a liquid container. The load could then be rotated for the customer to reach the other half of the load. Thus, if a full-pallet configuration requires a maximum reach of 48 inches to remove a liquid container, the half-pallet configuration would require a maximum reach of 24 inches to remove the liquid container.

In some embodiments, the pallet may be a rotating pallet 140. The rotating pallet 140 may rotate to allow access to different sides of the pallet. For example, a dairy case may be accessed by a customer using a door located on one side of the pallet. A customer may be unable to reach containers of milk located on the side of the pallet opposite the door. For example, the customer may be limited by the length of his reach or by a physical barrier such as the pallet divider 130. Rotating the rotating pallet 140 may allow the customer to access the pallet from any side. For example, the pallet may be rotated 180 degrees so the side opposite the door moves proximate to the door.

Although particular configurations of liquid containers 10 have been described with respect to FIG. 6, the distribution assembly 100 may be scaled to store and distribute any number and/or configuration of liquid containers 10.

Figure 7:
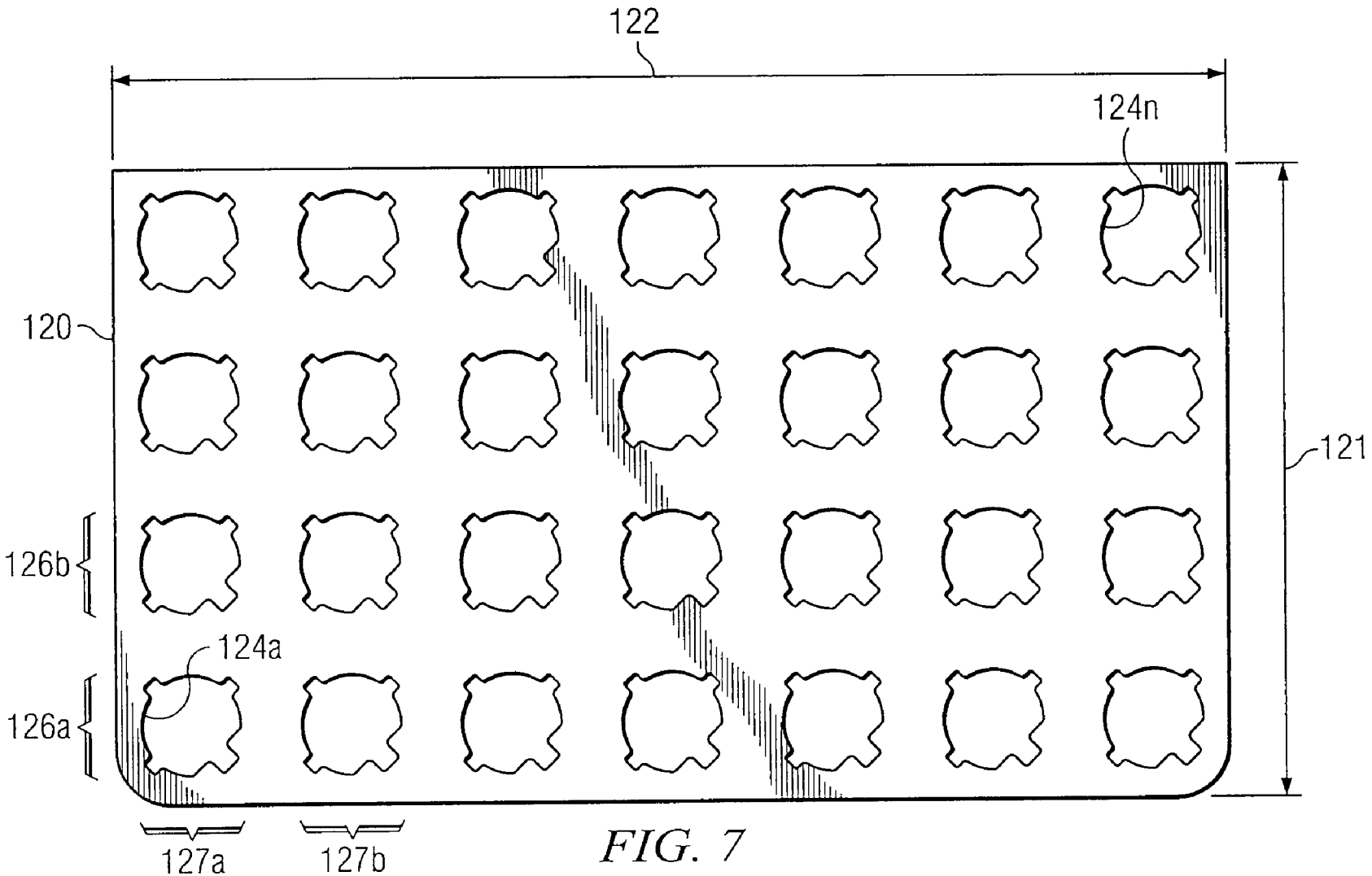
FIG. 7 illustrates an embodiment of a slip sheet that may be used in the distribution assembly of FIG. 6.

FIG. 7 illustrates an embodiment of a slip sheet 120 that may be used in the distribution assembly of FIG. 6. The slip sheet 120 may be substantially rectangular in shape with a sheet width 121 and a sheet length 122. The slip sheet 120 may be any suitable size. For example, the slip sheet 120 may be sized to fit a half-pallet configuration of liquid containers. A half-pallet configuration may have a sheet width 121 ranging from 22 to 26 inches, such as 23¾ inches, and a sheet length 122 ranging from 40 to 44 inches, such as 42 inches. The thickness of the slip sheet 120 may be less than one half of an inch to allow the slip sheet 120 to slip between the layers of the liquid containers. The slip sheet 120 may be corrugated cardboard or any suitable material.

The slip sheet 120 may comprise a number of cutouts 124 that allow it to fit over the top of a liquid container. In some embodiments, a cutout 124 may be shaped to allow the spout and part of the neck member of a liquid container to pass. Thus, the cutout 124 may be shaped to accommodate the handle and the ribs of the liquid container.

The cutouts 124 may be arranged in cutout rows 126 and cutout columns 127. The cutout rows 124 may run parallel to the sheet length 122 and the cutout columns may run perpendicular to the sheet length 122. The spacing between cutout rows 126 may be in the range of 5 to 7 inches, such as 6 1/16 inches. The spacing may be measured from the center of a first cutout 124 to the center of its closest neighboring cutout 124 in the same cutout row 126. Similarly, the spacing between cutout columns 127 may be in the range of 5 to 7 inches, such as 6 1/16 inches. The spacing may be measured from the center of a first cutout 124 to the center of its closest neighboring cutout 124 in the same cutout column 127.

An anchor cutout 124*a* may be located in a corner formed at an intersection of the edges of the slip sheet 120. In some embodiments, the distance between an edge of the slip sheet 120 and the center of the anchor cutout 124*a* along the sheet width 121 may be 3 inches. In some embodiments, the distance between an edge of the slip sheet 120 and the center of the anchor cutout 124*a* along the sheet length 122 may be 2 13/16 inches.

Figure 8:
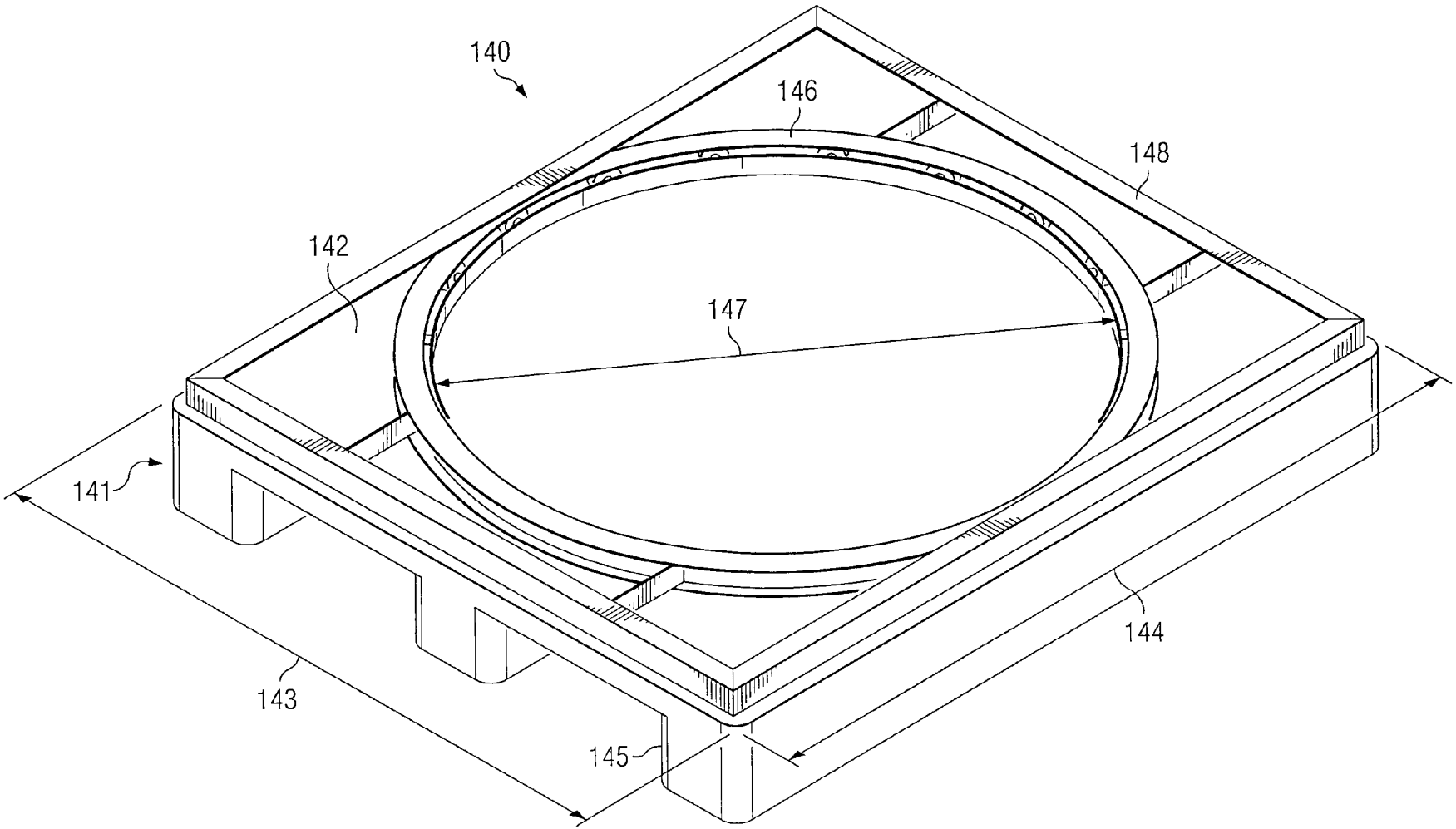
FIG. 8 illustrates an embodiment of a rotating pallet that may be used in the distribution assembly of FIG. 6.

FIG. 8 illustrates an embodiment of a rotating pallet 140 that may be used in the distribution assembly of FIG. 6. In some embodiments, the rotating pallet 140 may comprise a pallet base 141, a rotator ring 146, and/or a pallet frame 148. The rotating pallet 140 may be made of any generally rigid material that is sufficiently sturdy to support the weight of the liquid containers comprising a pallet. In one embodiment, the rotating pallet 140 is formed of a plastic material, such as polyurethane, a metal material, wood, or a combination. For example, the pallet base 141 may be made of plastic and the pallet frame 148 may be made of wood.

In some embodiments, the pallet base 141 may provide structural support to the rotating pallet 140. In some embodiments, the pallet base 141 may comprise a loading surface 142 and a number of feet 145. The loading surface 142 may be substantially flat and substantially rectangular in shape. The loading surface 142 may have a surface width 143 and a surface length 144. In some embodiments, the surface width 143 and the surface length 144 may be sized based on the dimensions of a load of liquid containers. For example, the surface width 143 may be equal to the width of the load plus or minus fifteen percent. Similarly, the surface length 144 may be equal to the length of the load plus or minus fifteen percent.

The feet 145 of the pallet base 141 may hold a load off the ground. The feet 145 may be placed substantially evenly around the rotating pallet 140 to allow for stability and even weight distribution. There may be spaces located between the feet 145 to allow a machine, such as a forklift, to access the bottom of the rotating pallet 140. For example, the forks of the forklift may fit between the feet 145 of the pallet base 141 to lift and move the rotating pallet 140 and its contents.

Figure 9:
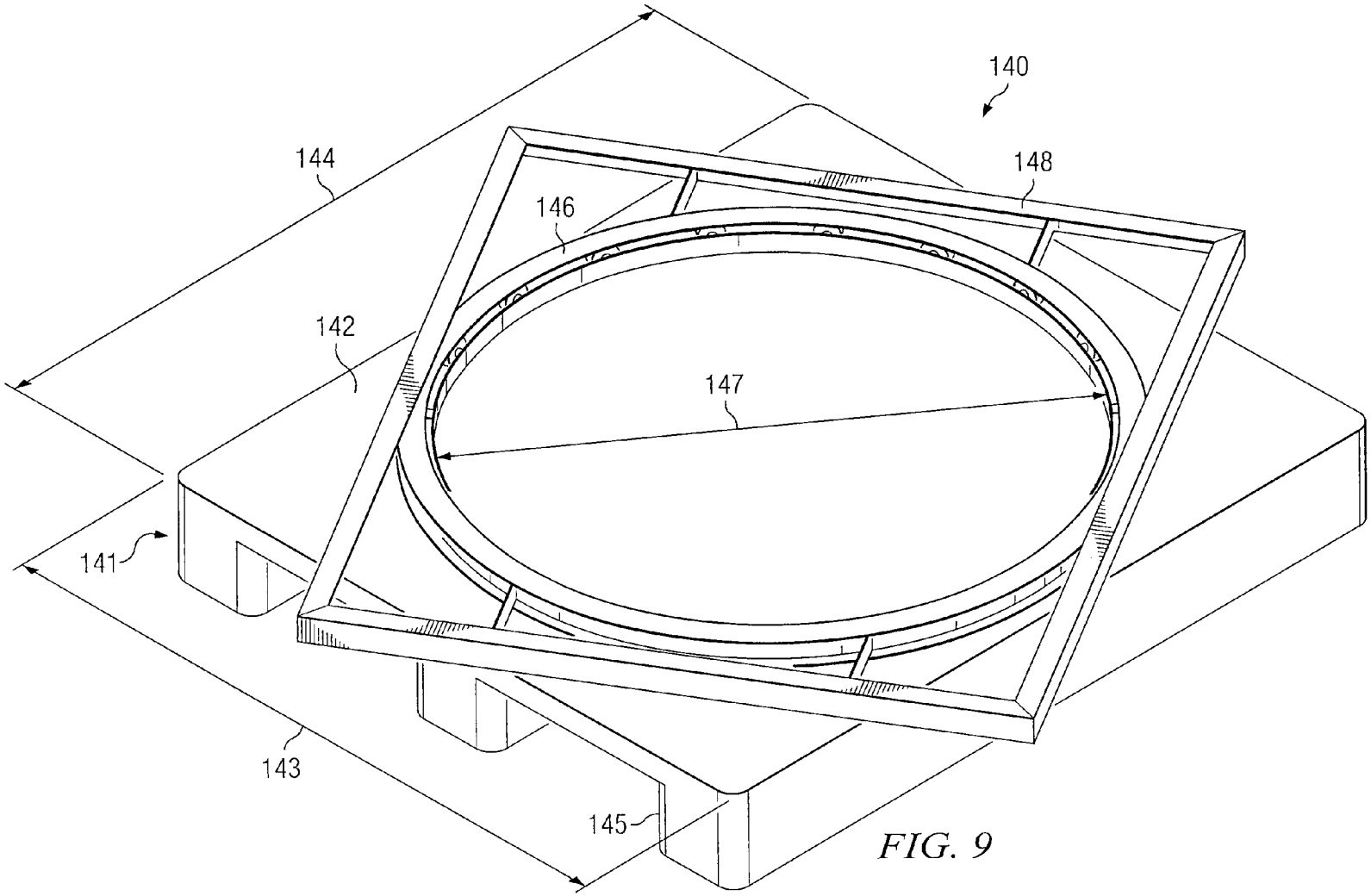
FIG. 9 illustrates the rotating pallet of FIG. 8 with the rotator ring partially rotated.

In some embodiments, the rotator ring 146 of the rotating pallet 140 may allow the pallet to be rotated. As an example, FIG. 9 illustrates an embodiment of the rotating pallet 140 with the rotator ring 146 partially rotated. The rotator ring 146 may be substantially circular in shape with a diameter 147 that is slightly shorter than the surface width 143 of the loading surface 142. In some embodiments, the rotator ring 146 may be positioned so that the diameter 147 runs parallel to the loading surface 142. Thus, the rotator ring 146 may rest flat against the loading surface 142, and it may be substantially centered on the loading surface 142. The rotator ring 146 may comprise a rotating mechanism that allows the load to be rotated around the circle. Any suitable rotating mechanism may be used. For example, a ball bearing mechanism may be used.

In some embodiments, the rotator ring 146 may be coupled to the pallet frame 148. The pallet frame 148 may provide stability to the load as it is rotated. The pallet frame 148 may have a frame width substantially equal to the surface width 143 and a frame length substantially equal to the surface length 144 of the loading surface 142. The rotator ring 146 may be coupled to the inside of the pallet frame 148 such that the center of the rotator ring 146 and the center of the pallet frame 148 substantially overlap.

The rotator ring 146 and pallet frame 148 may be coupled in any suitable manner. For example, metal fasteners may be used to couple rotator ring 146 and pallet frame 148. The fasteners may suspend the rotator ring 146 within the pallet frame 148, may couple the rotator ring 146 and the pallet frame 148 directly such that the rotator ring 146 and the pallet frame 148 physically touch, or a combination. For example, if the frame width and the frame length are not equal, the rotator ring 146 may be coupled directly to the pallet frame 148 along the frame width, and fasteners may extend between the rotator ring 146 and the pallet frame 148 along the frame length.

In some embodiments, the pallet holder, together with the liquid containers, the slip sheets, and the pallet divider, may be shipped from a manufacturer's location as a unit. Upon arrival at a retailer's location, such as a grocery store, the unit may be placed on the pallet frame 148 of the rotating pallet 140 so the customers may access the liquid containers. In some embodiments, the rotating pallet 140 may be kept at the retail location. This may reduce the risks and burdens of transporting a distribution apparatus back and forth between the retailer's location and the manufacturer's location.

Although an embodiment of the disclosure has been described using specific terms, such description is for illustrative purposes only. The words used are words of description rather than of limitation. It is to be understood that changes and variations may be made by those of ordinary skill in the art without departing from the spirit or scope of the present disclosure, which is set forth in the following claims. Therefore, the spirit and scope of the appended claims should not be limited to the description of the embodiments disclosed therein.

What is claimed is:

1. A distribution assembly comprising:

a load comprising a plurality of liquid containers; and a plurality of slip sheets, each slip sheet of the plurality of slip sheets configured to laterally group one or more liquid containers of the plurality of liquid containers, the slip sheet comprising:

a plurality of cutouts, each cutout configured to hold one liquid container of the plurality of liquid containers;

wherein each liquid container of the plurality of liquid containers comprises:

a base member;

a sidewall member that is attached to and extends upward from the base member;

a spout;

an upwardly converging neck member that couples the sidewall member and the spout, the neck member comprising at least one rib that extends from the spout to the sidewall member; and a handle that protrudes from the container proximate the neck member; and each slip sheet of the plurality of slip sheets further comprising:

each cutout shaped such that the spout, at least part of the neck member, and at least part of the handle of the one liquid container held by the cutout passes through the cutout.

2. The distribution assembly of claim 1, wherein each slip sheet of the plurality of slip sheets further comprises:

a sheet width of 22 to 26 inches;

a sheet length of 40 to 44 inches; and the cutouts arranged in a plurality of cutout rows and a plurality of cutout columns, the cutout rows running parallel to the sheet length, the cutout columns running perpendicular to the sheet length, the cutouts spaced such that:

a first center of a first cutout in a first cutout row and a first cutout column is 5 to 7 inches from the center of a second cutout in the first cutout row and a second cutout column; and the first center of the first cutout is 5 to 7 inches from a third center of a third cutout in a second cutout row and the first cutout column.

3. The distribution assembly of claim 1, further comprising:

the plurality of liquid containers arranged in a plurality of layers, each layer of the plurality of layers extending in a lateral direction, the layers arranged such that a first layer is stacked on a second layer in a vertical direction; and each slip sheet of the plurality of slip sheets configured to group one or more liquid containers of a same layer.

4. The distribution assembly of claim 1, wherein the neck member comprises at least one rib that extends from the spout to the sidewall member.

5. The distribution assembly of claim 4, the handle being radially spaced apart from the at least one rib.

6. The distribution assembly of claim 1, wherein the spout of a first one of the containers passes through its corresponding cutout and nests within a recessed portion of an above-stacked one of the containers.

7. The distribution assembly of claim 6, wherein at least a portion of the base member of the above-stacked container generally conforms to an upper contour formed by the neck member of the first container such that the second container is partially seated upon the neck member of the first container.

8. The distribution assembly of claim 7, wherein the base member of the above-stacked container is partially seated on the corresponding slip sheet.

9. A distribution assembly comprising:

a load comprising a plurality of liquid containers the plurality of liquid containers arranged vertically to form a plurality of container stacks;

a plurality of slip sheets, each slip sheet of the plurality of slip sheets configured to laterally group one or more liquid containers of the plurality of liquid containers, the slip sheet comprising:

a plurality of cutouts, each cutout configured to hold one liquid container of the plurality of liquid containers;

a pallet divider, the pallet divider dividing the plurality of container stacks into a first section and a second section, the pallet divider restricting access to the second section to distribute the liquid containers of the first section; and a rotating pallet configured to rotate to distribute the liquid containers of the second section.

10. The distribution assembly of claim 9, wherein the rotating pallet is positioned proximate to a door of a dairy case and the pallet divider is positioned to restrict access from the door to a subset of the containers positioned opposite the door.

11. A distribution assembly comprising:

a load comprising a plurality of liquid containers;

a plurality of slip sheets, each slip sheet of the plurality of slip sheets configured to laterally group one or more liquid containers of the plurality of liquid containers, the slip sheet comprising:

a plurality of cutouts, each cutout configured to hold one liquid container of the plurality of liquid containers;

a rotating pallet configured to support the load, the rotating pallet comprising:

a pallet base having a loading surface shaped in a substantially flat and substantially rectangular shape, the loading surface having a surface width and a surface length;

a rotator ring substantially centered on the loading surface, the rotator ring substantially shaped as a circle, the circle having a diameter slightly shorter than the surface width, the diameter running parallel to the loading surface, the rotator ring configured to rotate the load around the circle; and a pallet frame coupled to the rotator ring, the pallet frame having a frame width substantially equal to the surface width and a frame length substantially equal to the surface length.

12. The distribution assembly of claim 11, further comprising a pallet holder, the pallet holder comprising a five-sided box, the pallet holder configured to provide a surface on which a bottom layer of the liquid containers may rest.

13. The distribution assembly of claim 11, further comprising:

a pallet holder configured to provide a surface on which a bottom layer of the liquid containers may rest, the pallet holder wherein:

the pallet holder has five sides;

the pallet holder is made of a disposable material; and the pallet holder has a pallet holder height less than six inches.

14. The distribution assembly of claim 11, wherein the rotator ring comprises a plurality of ball bearings.

15. The distribution assembly of claim 11, the rotator ring coupled to the pallet frame such that:

the rotator ring physically contacts the sides of the pallet frame that extend in the width direction; and fasteners extend between the rotator ring and the sides of the pallet frame that extend in the length direction.

16. The distribution assembly of claim 11, wherein:

the pallet base comprises a plurality of feet spaced substantially evenly apart;

the rotator ring comprises a plurality of ball bearings; and the rotator ring coupled to the pallet frame such that:

the rotator ring physically contacts the sides of the pallet frame that extend in the width direction; and fasteners extend between the rotator ring and the sides of the pallet frame that extend in the length direction.

17. The distribution assembly of claim 11, wherein the pallet base comprises a plurality of feet.

18. The distribution assembly of claim 17, the plurality of feet spaced substantially evenly apart.

19. A distribution assembly comprising:

a load comprising a plurality of liquid containers, the plurality of liquid containers arranged in a plurality of layers, each layer of the plurality of layers extending in a lateral direction, the plurality of liquid containers further arranged vertically to form a plurality of container stacks;

a plurality of slip sheets, each slip sheet configured to group one or more liquid containers of a same layer, each slip sheet further comprising:

a plurality of cutouts, each cutout configured to hold one liquid container of the plurality of liquid containers;

a pallet divider, the pallet divider dividing the plurality of container stacks into a first section and a second section; and a rotating pallet configured to support and rotate the load.

20. The distribution assembly of claim 19, wherein each slip sheet of the plurality of slip sheets further comprises:

a sheet width of 22 to 26 inches;

a sheet length of 40 to 44 inches; and the cutouts arranged in a plurality of cutout rows and a plurality of cutout columns, the cutout rows running parallel to the sheet length, the cutout columns running perpendicular to the sheet length, the cutouts spaced such that:

a first center of a first cutout in a first cutout row and a first cutout column is 5 to 7 inches from the center of a second cutout in the first cutout row and a second cutout column; and the first center of the first cutout is 5 to 7 inches from a third center of a third cutout in a second cutout row and the first cutout column.

21. The distribution assembly of claim 19, further comprising:

each liquid container of the plurality of liquid containers further comprising:

a base member;

a sidewall member that is attached to and extends upward from the base member;

a spout;

an upwardly converging neck member that couples the sidewall member and the spout, the neck member comprising at least one rib that extends from the spout to the sidewall member; and a handle that protrudes from the container proximate the neck member; and each slip sheet of the plurality of slip sheets further comprising:

each cutout shaped such that the spout, at least part of the neck member, and at least part of the handle of the one liquid container held by the cutout passes through the cutout.

22. The distribution assembly of claim 19, wherein the rotating pallet comprises:

a pallet base having a loading surface shaped in a substantially flat and substantially rectangular shape, the loading surface having a surface width and a surface length;

a rotator ring substantially centered on the loading surface, the rotator ring substantially shaped as a circle, the circle having a diameter slightly shorter than the surface width, the diameter running parallel to the loading surface, the rotator ring configured to rotate the load around the circle; and a pallet frame coupled to the rotator ring, the pallet frame having a frame width substantially equal to the surface width and a frame length substantially equal to the surface length.

* * * * *